US009449555B2

(12) United States Patent
Jeong

(10) Patent No.: US 9,449,555 B2
(45) Date of Patent: Sep. 20, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventor: Cheol Yun Jeong, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 45 days.

(21) Appl. No.: 14/598,184

(22) Filed: Jan. 15, 2015

(65) Prior Publication Data

US 2016/0019843 A1 Jan. 21, 2016

(30) Foreign Application Priority Data

Jul. 16, 2014 (KR) ..... 10-2014-0089913

(51) Int. Cl.

| | |
|---|---|
| ***G09G 3/00*** | (2006.01) |
| ***G09G 3/32*** | (2016.01) |
| ***G09G 3/20*** | (2006.01) |

(52) U.S. Cl.

CPC .... *G09G 3/3233* (2013.01); *G09G 2300/0866* (2013.01); *G09G 2310/0251* (2013.01)

(58) Field of Classification Search

CPC .. G09G 3/003; G09G 3/3233; G09G 3/3266; G09G 3/3258; G09G 3/3291; G09G 3/2048; G09G 3/2018

See application file for complete search history.

(56) References Cited

U.S. PATENT DOCUMENTS

| | | | | |
|---|---|---|---|---|
| 8,976,166 | B2 * | 3/2015 | Han | G09G 3/3233 345/208 |
| 2009/0051628 | A1 * | 2/2009 | Kwon | G09G 3/3233 345/77 |
| 2012/0147060 | A1 * | 6/2012 | Jeong | G09G 3/3233 345/690 |
| 2014/0071027 | A1 * | 3/2014 | Jin | G09G 3/3291 345/76 |
| 2014/0084805 | A1 * | 3/2014 | Kim | G09G 3/2048 315/228 |
| 2014/0111503 | A1 * | 4/2014 | Kwon | G09G 3/3233 345/213 |
| 2014/0132162 | A1 * | 5/2014 | Kim | G09G 3/3266 315/161 |
| 2014/0139408 | A1 * | 5/2014 | Kim | G09G 3/3233 345/76 |
| 2014/0139502 | A1 * | 5/2014 | Han | G09G 3/3233 345/212 |

(Continued)

FOREIGN PATENT DOCUMENTS

| | | |
|---|---|---|
| KR | 10-2004-0021753 | 3/2004 |
| KR | 10-2010-0093450 | 8/2010 |
| KR | 10-1139408 | 4/2012 |
| KR | 10-2013-0132708 | 12/2013 |

*Primary Examiner* — Lin Li

(74) *Attorney, Agent, or Firm* — Lewis Roca Rothgerber Christie LLP

(57) ABSTRACT

Aspects of embodiments of the present invention include a display device including: a display unit comprising a plurality of scan lines that extend in a row direction, a plurality of data lines that extend in a column direction, and a plurality of pixels coupled to the scan lines and the data lines; a scan driver configured to sequentially apply a scan signal of a gate-on voltage to the scan lines during a writing period for applying a data voltage to the pixels; and a data driver configured to apply a data voltage to the data lines during the writing period, wherein a first power source voltage supplying a driving current of the pixels is applied to the data lines during a period other than the writing period.

15 Claims, 5 Drawing Sheets

(56) References Cited

U.S. PATENT DOCUMENTS

2014/0139565 A1* 5/2014 Choi ..... G09G 3/2018 345/691
2014/0240368 A1* 8/2014 Koh ..... G09G 3/3258 345/690
2014/0292623 A1* 10/2014 Moon ..... G09G 3/3233 345/82
2014/0307010 A1* 10/2014 Han ..... G09G 3/3233 345/691
2014/0354522 A1* 12/2014 Chung ..... G09G 3/003 345/82
2015/0002560 A1* 1/2015 Kwon ..... G09G 3/3266 345/691
2015/0123557 A1* 5/2015 Lee ..... G09G 3/3233 315/228

* cited by examiner

DISPLAY DEVICE AND DRIVING METHOD THEREOF

CROSS-REFERENCE TO RELATED APPLICATION

This application claims priority to and the benefit of Korean Patent Application No. 10-2014-0089913 filed in the Korean Intellectual Property Office on Jul. 16, 2014, the entire contents of which are incorporated herein by reference.

BACKGROUND

1. Field

Embodiments of the present invention relate to a display device and a driving method thereof.

2. Description of the Related Art

Various kinds of display devices that are capable of reducing negative characteristics of cathode ray tubes (CRT), such as their heavy weight and large size, have been developed in recent years. Such display devices include liquid crystal displays (LCDs), field emission displays (FEDs), plasma display panels (PDPs), and organic light emitting diode (OLED) displays.

An OLED display uses an OLED in which luminance is controlled by a current or a voltage. The organic light emitting diode includes an anode layer and a cathode layer generating an electric field, and an organic light emitting material emitting light due to the electric field.

In general, OLED displays are classified into either passive matrix OLED (PMOLED) displays and active matrix OLED (AMOLED) displays, according to a driving mode of the display. Among the categories of OLED displays, the active matrix OLED display, which emits light selected for each unit pixel in terms of resolution, contrast, and operation speed have become mainstream.

One pixel of the active matrix OLED display includes the OLED, a driving transistor that controls a current amount that is supplied to the OLED, and a switching transistor that transmits the data voltage that controls the light emitting amount of the OLED to the driving transistor.

An OLED display additionally may include a power source voltage wire for supplying a current to an OLED, and a data voltage wire. The power source voltage wire and the data voltage wire are arranged in parallel in a column direction.

Display devices which have recently been being developed have a design space that is reduced to improve the resolution. A line width of wires and spaces between the wires may need to be decreased by as much as the design space reduction. As the spaces between the wires are reduced, short-circuit errors between the wires caused by particles may increase. For example, the power source voltage wire and the data voltage wire may be adjacently arranged in parallel, and thus the short-circuit errors may be easily generated.

The above information disclosed in this Background section is only for enhancement of understanding of the background of the invention and therefore it may contain information that does not form the prior art that is already known in this country to a person of ordinary skill in the art.

SUMMARY

Embodiments of the present invention relate to a display device and a driving method thereof, and more particularly, to a display device and a driving method thereof, which facilitates a high-resolution display by reducing the number of wires.

Aspects of embodiments of the present invention include a display device and a driving method thereof, having characteristics of being configured such that a power source voltage and a data voltage can be applied through one wire.

Aspects of embodiments of the present invention include a display device including: a display unit including a plurality of scan lines that extend in a row direction, a plurality of data lines that extend in a column direction, and a plurality of pixels coupled to the scan lines and the data lines; a scan driver configured to sequentially apply a scan signal of a gate-on voltage to the scan lines during a writing period for applying a data voltage to the pixels; and a data driver configured to apply a data voltage to the data lines during the writing period, wherein a first power source voltage supplying a driving current of the pixels is applied to the data lines during a period other than the writing period.

The display device may further include a mux coupled to the data lines, to selectively transfer the data voltage and the first power source voltage to the data lines.

The display device may further include an initialization signal applier configured to apply an initialization signal for initializing a gate voltage of a driving transistor included in each of the pixels.

The display device may further include a light emission signal applier configured to apply a light emission signal for controlling a light emission period of the pixels.

Each of the pixels may include: an organic light emitting diode; a driving transistor including a gate electrode coupled to a first node, a first electrode coupled to one of the pixels, and a second electrode coupled to a second node; a switching transistor including a gate electrode to which the scan signal is applied, a first electrode coupled to the first node, and a second electrode coupled to the second node; and a light emitting transistor including a gate electrode to which the light emission signal is applied, a first electrode coupled to the second node, and a second electrode coupled to the organic light emitting diode.

Each of the may pixels further include: an initialization transistor including a gate electrode to which the initialization signal is applied, a first electrode coupled to the first node, and a second electrode to which an initialization voltage is applied; and a storage capacitor including a first electrode coupled to the first node and a second electrode to which the initialization voltage is applied.

The initialization signal applier may concurrently apply an initialization signal of a gate-on voltage during an initialization period before the writing period.

The light emission signal applier may concurrently apply a light emission signal of a gate-on voltage to the pixels during a light emission period after the writing period.

Aspects of embodiments of the present invention include a display device including: a plurality of scan lines that extend in a row direction; a plurality of data lines that extend in a column direction; and a plurality of pixels coupled to the scan lines and the data lines, wherein a scan signal of a gate-on voltage is sequentially applied to the pixels during a writing period for applying a data voltage to the pixels, a data voltage is applied to the data lines during the writing period, and a first power source voltage supplying a driving current of the pixels is applied to the data lines during a period other than the writing period.

Each of the pixels may include: an organic light emitting diode; a driving transistor including a gate electrode coupled to a first node, a first electrode coupled to one of the pixels, and a second electrode coupled to a second node; a switching transistor including a gate electrode to which the scan signal is applied, a first electrode coupled to the first node, and a second electrode coupled to the second node; and a light emitting transistor including a gate electrode to which a light emission signal is applied, a first electrode coupled to the second node, and a second electrode coupled to the organic light emitting diode.

Each of the pixels may further include: an initialization transistor including a gate electrode to which an initialization signal is applied, a first electrode coupled to the first node, and a second electrode to which an initialization voltage is applied; and a storage capacitor including a first electrode coupled to the first node and a second electrode to which the initialization voltage is applied.

The initialization signal may be concurrently applied to the pixels as a gate-on voltage during an initialization period of the writing period.

The light emission signal may be concurrently applied to the pixels as a gate-on voltage during a light emission period after the writing period.

According to some embodiments of the present invention, in a driving method of a display device, the display device includes an organic light emitting diode, a driving transistor configured to control a driving current that is supplied from a data line to the organic light emitting diode, a switching transistor configured to perform a diode connection of the driving transistor, a light emitting transistor configured to transfer the driving current from the driving transistor to the organic light emitting diode, an initialization transistor configured to transfer a gate electrode of the driving transistor, and a storage capacitor configured to store a gate voltage of the driving transistor, the driving method includes: initializing the gate voltage of the driving transistor as the initialization voltage by applying an initialization signal of a gate-on voltage to a gate electrode of the initialization transistor during an initialization period; storing a driving voltage on which a data voltage and a threshold voltage of the driving transistor are reflected in the storage capacitor by applying a scan signal of a gate-on voltage to a gate electrode of the switching transistor and the data voltage to the data line during a writing period; and enabling the organic light emitting diode to emit light by applying a light emission signal of a gate-on voltage to a gate electrode of the light emitting transistor during a light emission period.

The initialization signal of the gate-on voltage may be concurrently applied to a plurality of pixels of the display device.

The scan signal of the gate-on voltage may be sequentially applied to a plurality of scan lines that are coupled to a plurality of pixels of the display device during the writing period.

A first power source voltage for supplying a driving current of a plurality of pixels of the display device may be applied to the data line during the light emission period.

The light emission signal of the gate-on voltage may be concurrently applied to a plurality of pixels of the display device.

The first power source voltage may be applied to the data line during the initialization period.

According to example embodiments of the present invention, the design space can be reduced to improve the resolution of the display device by configuring the power source voltage and the data voltage to be applied through one wire, and thus instances of short-circuit errors may be prevented (or reduced) from being generated between the wire of the power source voltage and the wire of the data voltage. Further, a high-resolution display may be produced by reducing the number of wires of the display device.

DETAILED DESCRIPTION

Figure 1:
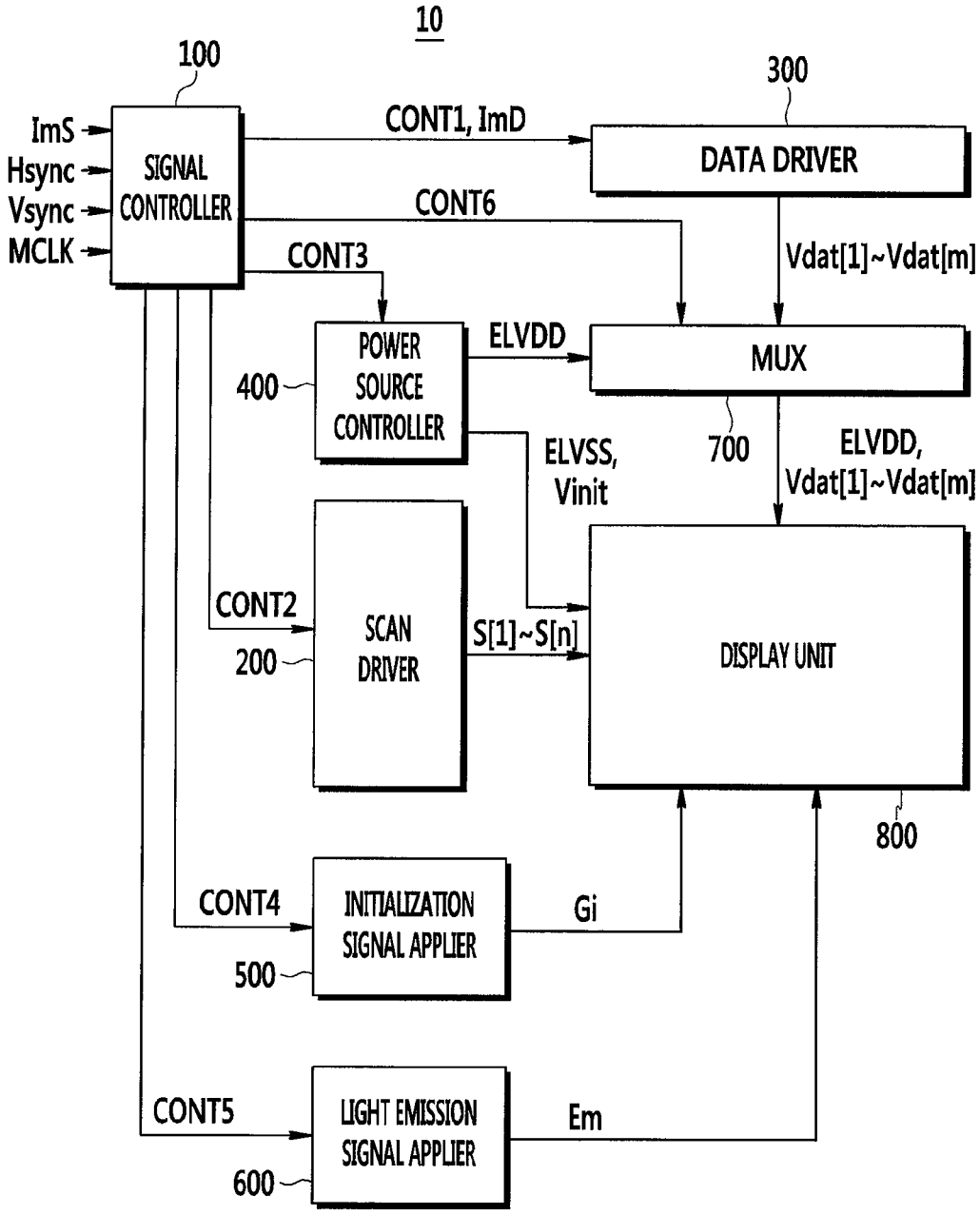
FIG. 1 is a block diagram illustrating a display device according to an example embodiment of the present invention.

Hereinafter, example embodiments of the present invention will be described in some detail with reference to the attached drawings such that aspects of the present invention can be easily put into practice by those skilled in the art. As those skilled in the art would realize, the described embodiments may be modified in various different ways, all without departing from the spirit or scope of the present invention.

In addition, in various example embodiments, the same constituent elements are denoted by the same reference numerals and are representatively described in an example embodiment, and different elements from the elements of the example embodiment are described in other example embodiments.

In the drawings and this specification, parts or elements that are not related to the description hereof are omitted in order to clearly describe the present invention, and the same or like constituent elements are designated by the same reference numerals throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram illustrating a display device according to an example embodiment of the present invention.

Referring to FIG. 1, the display device 10 includes a signal controller 100, a scan driver 200, a data driver 300, a power source controller 400, an initialization signal applier 500, a light emission signal applier 600, a mux 700, and a display unit 800.

The signal controller 100 receives an image signal ImS input from an external device, and a synchronization signal. The image signal ImS stores luminance information of a plurality of pixels. The luminance has a number (e.g., a predetermined number) of grays, for example, 1024 ($=2^{10}$), 256 ($=2^{8}$) or 64 ($=2^{6}$) grays. The synchronization signal includes a horizontal synchronization signal Hsync, a vertical synchronization signal Vsync, and a main clock signal MCLK.

The signal controller 100 generates first to sixth driving control signals CONT1, CONT2, CONT3, CONT4, CONT5, and CONT6 and an image data signal ImD according to the image signal ImS, the horizontal synchronization signal Hsync, the vertical synchronization signal Vsync, and the main clock signal MCLK.

The signal controller 100 divides the image signal ImS by a frame unit according to the vertical synchronization signal Vsync, and divides the image signal ImS by a scan line unit according to the horizontal synchronization signal Hsync to generate image data ImD. The signal controller 100 transfers the image data ImD to the data driver 300 together with the first driving control signal CONT1.

The display unit 800 is a display area including a plurality of pixels. In the display unit 800, a plurality of scan lines extend substantially in a row direction to be substantially parallel to each other, a plurality of data lines extend substantially in a column direction to be substantially parallel to each other, a plurality of power lines, a plurality of initialization lines, and a plurality of light emission control lines are formed to be coupled to the pixels. The pixels are arranged substantially in a matrix form.

The scan driver 200 is coupled to the scan lines to generate a plurality of scanning signals S[1] to S[n] according to the second driving control signal CONT2. The scan driver 200 may sequentially apply the scanning signals S[1] to S[n] of gate-on voltages to the scan lines.

The data driver 300 is coupled to the data lines to sample and hold the image data ImD input according to the first driving control signal CONT1, and apply a plurality of data signals Vdat[1] to Vdat[m] to the data lines, respectively The data driver 300 may apply the data signals Vdat[1] to Vdat[m] having a voltage range (e.g., a predetermined voltage range) to the data lines in response to the scanning signals S[1] to S[n] of gate-on voltages.

The power source controller 400 generates a first power source voltage ELVDD, a second power source voltage ELVSS, and an initialization voltage Vinit. The power source controller 400 can determine levels of the first power source voltage ELVDD, the second power source voltage ELVSS, and the initialization voltage Vinit according to the third driving control signal CONT3. The first power source voltage ELVDD is a high level voltage, and the second power source voltage ELVSS is a low level voltage. The first power source voltage ELVDD and the second power source voltage ELVSS serve to supply pixel driving currents. The initialization voltage Vinit may be a low level voltage such as a ground voltage. The power source controller 400 may be coupled to a plurality of data lines through the mux 700 to apply the first power source voltage ELVDD to the data lines through the mux 700. The power source controller 400 serves to apply the second power source voltage ELVSS and the initialization voltage Vinit to the power source line.

The initialization signal applier 500 is coupled to the initialization lines to apply an initialization signal Gi to the initialization lines according to the fourth driving control signal CONT4. The initialization signal Gi serves to initialize a driving voltage of the driving transistor included in each of the pixels.

The light emission signal applier 600 is coupled to a plurality of light emission lines to apply a light emission signal Em to the light emission lines according to the fifth driving control signal CONT5. The light emission signal Em facilitates flowing of a driving current in the pixels to enable the pixels to emit light.

The mux 700 is coupled to the data lines to receive a plurality of data voltages Vdat[1]-Vdat[m] from the data driver 300 and the first power source voltage ELVDD from the power source controller 400. The mux 700 can serve to transfer the data voltages Vdat[1]-Vdat[m] and the first power source voltage ELVDD according to the sixth driving control signal CONT6. For example, the mux 700 may be configured to transfer the first power source voltage ELVDD to the data lines during an initialization period "a" and a light emission period "c," which will be described, and to transfer the data voltage Vdat[1]-Vdat[m] to the data lines during a writing period "b."

Figure 2:
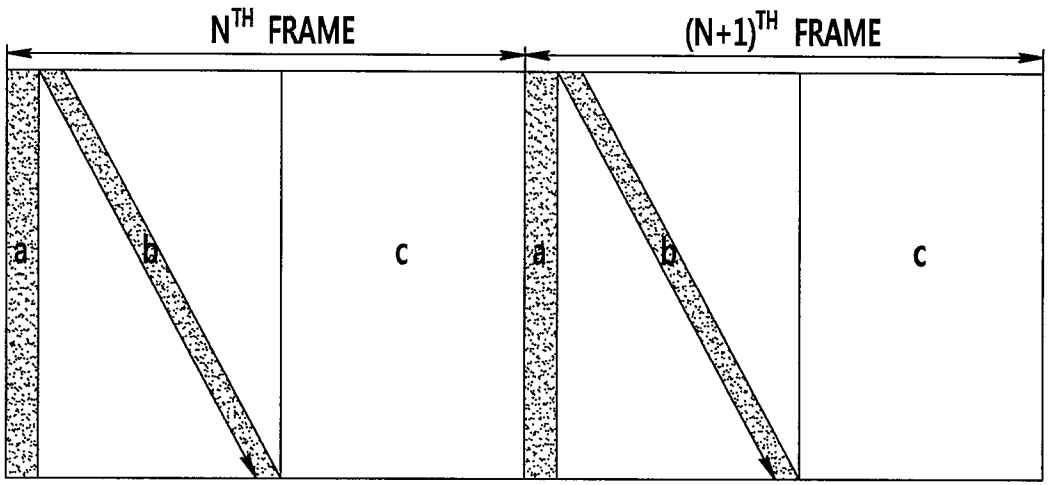
FIG. 2 is a timing diagram illustrating a concurrent (e.g., simultaneous) light emission method of a display device according to an example embodiment of the present invention.

FIG. 2 is a timing diagram illustrating a concurrent (e.g., simultaneous) light emission method of a display device according to an example embodiment of the present invention.

Referring to FIG. 2, it is assumed that the display device according to the present invention is an organic light emitting diode display employing the organic light emitting diode.

One frame period during which one image is displayed on the display unit 800 includes the initialization period "a" during which a gate voltage of each of the pixels is initialized, the writing period "b" during which a data voltage is applied to each of the pixels, and the light emission period "c" during which the pixels emit light in response to the applied data voltage.

As described above, an operation at the writing period "b" is sequentially performed per scan line, while operations at the initialization period "a" and the light emission period "c" are concurrently (e.g., simultaneously) performed throughout the display unit 800.

The data driver 300 may generate the data voltages Vdat[1]-Vdat[m] during the writing period "b" to apply them to the data lines. The power source controller 400 may apply the first power source voltage ELVDD to the data lines during periods other than the writing period "b", that is, the initialization period "a" and the light emission period "c".

Figure 3:
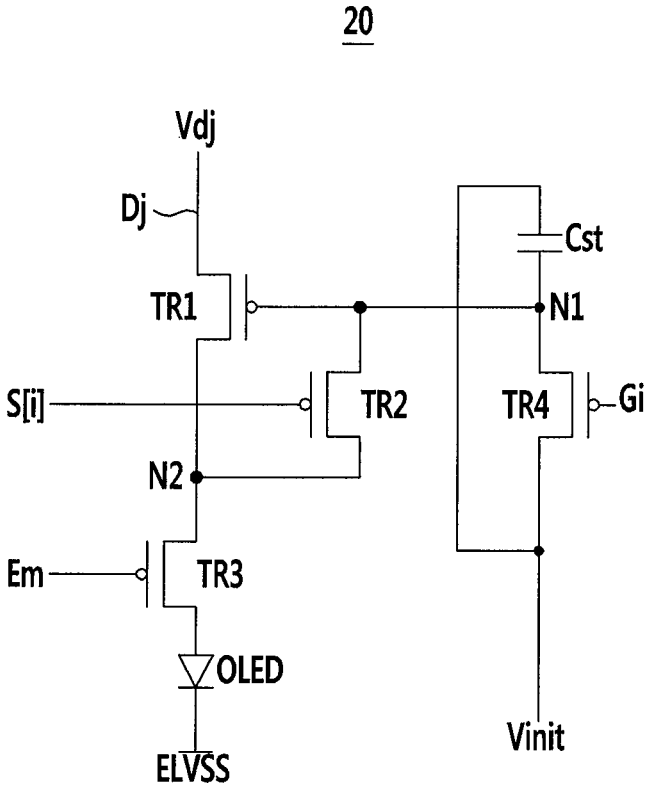
FIG. 3 is a circuit diagram illustrating a pixel according to an example embodiment of the present invention.

FIG. 3 is a circuit diagram illustrating a pixel according to an example embodiment of the present invention. Specifically, FIG. 3 illustrates one pixel 20 of the pixels included in the display device 10 of FIG. 1 (1*n*, Referring to FIG. 3, the pixel 20 includes a driving transistor TR1, a switching transistor TR2, a light emitting transistor TR3, an initialization transistor TR4, a storage capacitor Cst, and an organic light emitting diode OLED.

The driving transistor TR1 includes a gate electrode that is coupled to a first node N1, a first electrode that is coupled to a data line Dj, and a second electrode that is coupled to a second node N2. The driving transistor TR1 serves to control a driving current that is supplied to the organic light emitting diode OLED through the data line.

The switching transistor TR2 includes a gate electrode to which a scan signal S[i] is applied, a first electrode that is coupled to the first node N1, and a second electrode that is coupled to the second node N2. The switching transistor TR2 is turned on by the scan signal S[i] of a gate-on voltage to perform diode-connection of the driving transistor TR1.

The light emitting transistor TR3 includes a gate electrode to which a light emission signal Em is applied, a first electrode that is coupled to the second node N2, and a second electrode that is coupled to an anode of the organic light emitting diode OLED. The light emitting transistor TR3 is turned on by the light emission signal Em of the gate-on voltage to transfer the driving current from the driving transistor TR1 to the organic light emitting diode OLED.

The initialization transistor TR4 includes a gate electrode to which an initialization signal Gi is applied, a first electrode that is coupled to the first node N1, and a second electrode to which an initialization voltage Vinit is applied. The initialization transistor TR4 is turned on by the initialization signal Gi of the gate-on voltage to transfer the initialization voltage Vinit to the first node N1.

Each of the driving transistor TR1, the switching transistor TR2, the light emitting transistor TR3, and the initialization transistor TR4 may be a p-channel electric field effect transistor. In this case, the gate-on voltage for turning on the p-channel electric field effect transistor is a low level voltage, and the gate-off voltage for turning off the same is a high level voltage.

Herein, the p-channel electric field effect transistor is illustrated, but at least one of the driving transistor TR1, the switching transistor TR2, the light emitting transistor TR3, and the initialization transistor TR4 may be an n-channel electric field effect transistor. In this case, a gate-on voltage for turning on the n-channel electric field effect transistor is a high level voltage, and a gate-off voltage for turning off the same is a low level voltage.

The storage capacitor Cst includes a first electrode that is coupled to the first node N1, and a second electrode to which the initialization voltage Vinit is applied. The storage capacitor Cst maintains a voltage of the first node N1, that is, the gate voltage of the driving transistor TR1.

The organic light emitting diode OLED includes an anode electrode that is coupled to the second electrode of the light emitting transistor TR3, and a cathode electrode that is coupled to the second power source voltage ELVSS. The organic light emitting diode OLED may emit light with one of primary colors. Examples of the primary color include three primary colors such as red, green, and blue, and a desired color may be displayed by spatial sum or a temporal sum of the three primary colors.

The organic light emitting diode OLED includes an organic emission layer. The organic emission layer may be made of low molecular weight organic materials or high molecular weight organic materials such as poly(3,4-ethylenedioxythiophene) (PEDOT). Further, the organic emission layer may be formed of a multilayer including at least one of a light emitting layer, a hole injection layer (HIL), a hole transporting layer (HTL), an electron transporting layer (ETL), and an electron injection layer (EIL). When the organic emission layer includes all of them, the hole injection layer is located on a pixel electrode which is an anode, and the hole transporting layer, the light emitting layer, the electron transporting layer, and the electron injection layer are sequentially stacked thereon.

The organic emission layer may include a red organic emission layer emitting red light, a green organic emission layer emitting green light, and a blue organic emission layer emitting blue light. The red organic emission layer, the green organic emission layer, and the blue organic emission layer are formed in a red pixel, a green pixel, and a blue pixel, respectively, thereby implementing a color image.

Further, the organic emission layer may implement the color image by laminating the red organic emission layer, the green organic emission layer, and the blue organic emission layer together in the red pixel, the green pixel, and the blue pixel, and forming a red color filter, a green color filter, and a blue color filter for each pixel. As another example, white organic emission layers emitting white light are formed in each of the red pixel, the green pixel, and the blue pixel, and a red color filter, a green color filter, and a blue color filter are formed for each pixel, thereby implementing the color image. In the case of implementing the color image by using the white organic emission layer and the color filters, a deposition mask for depositing the red organic emission layer, the green organic emission layer, and the blue organic emission layer on respective pixels, that is, the red pixel, the green pixel, and the blue pixel, does not need to be used.

The white organic emission layer described in another example may be formed by one organic emission layer, and includes a configuration formed so as to emit white light by laminating a plurality of organic emission layers. For example, the white organic emission layer may include configurations emitting white light by combining at least one yellow organic emission layer and at least one blue organic emission layer, combining at least one cyan organic emission layer and at least one red organic emission layer, and combining at least one magenta organic emission layer and at least one green organic emission layer.

In the meantime, at least one of the driving transistor TR1, the switching transistor TR2, the light emitting transistor TR3, and the initialization transistor TR4 may be an oxide thin film transistor (oxide TFT) in which a semiconductor layer is formed of an oxide semiconductor.

The oxide semiconductor may include one of an oxide based on titanium (Ti), hafnium (Hf), zirconium (Zr), aluminum (Al), tantalum (Ta), germanium (Ge), zinc (Zn), gallium (Ga), tin (Sn), or indium (In), such as zinc oxide (ZnO), indium-gallium-zinc oxide ($InGaZnO_4$), indium-zinc oxide (Zn—In O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium gallium oxide (In—Ge—Ga—O), titanium-indium-zinc oxide (Ti—In—Zn—O), and hafnium-indium-zinc oxide (Hf—In—Zn—O) which are complex oxides thereof.

The semiconductor layer includes a channel region which is not doped with impurities, and a source region and a drain region which are formed by doping both sides of the channel region with impurities. Herein, the impurities vary depending on a kind of thin film transistor, and may be an N-type impurity or a P-type impurity.

When the semiconductor layer is made of the oxide semiconductor, a separate protective layer may be added to protect the oxide semiconductor, which is vulnerable to external environments, such as being exposed to a high temperature.

Hereinafter, a driving method of a display device will be described in detail with reference to FIG. 3 and FIG. 4.

Figure 4:
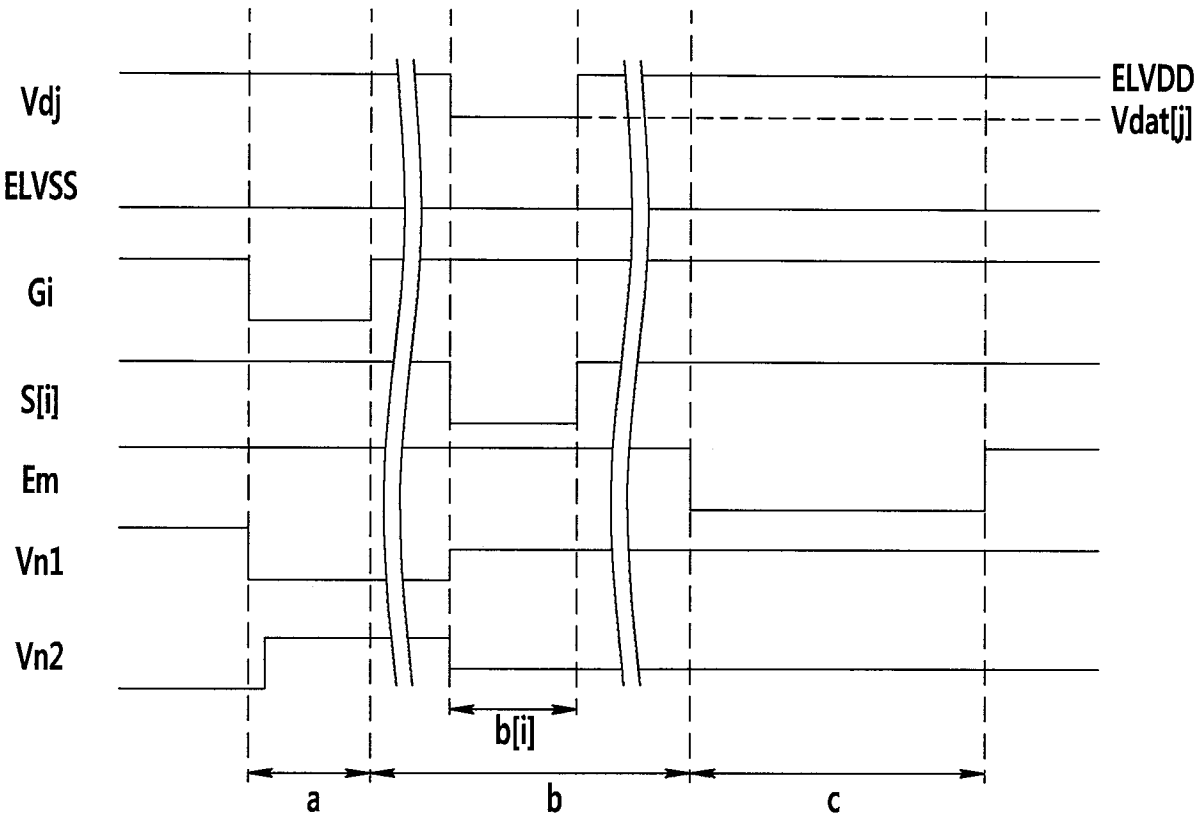
FIG. 4 is a timing diagram illustrating a driving method of a display device according to an example embodiment of the present invention.

FIG. 4 is a timing diagram illustrating a driving method of a display device according to an example embodiment of the present invention.

Referring to FIG. 3 and FIG. 4, during the initialization period "a", the initialization signal Gi is applied as a gate-on voltage, and the scan signal S[i] and the light emission signal Em is applied as a gate-off voltage. In this case, the first power source voltage ELVDD is applied to the data line Dj, and a voltage Vdj of the data line Dj is a high level voltage. The initialization transistor TR4 is turned on by the initialization signal Gi of the gate-on voltage to transfer the initialization voltage Vinit to the first node N1. A voltage Vn1 of the first node N1 is an initialization voltage Vinit, i.e., a low level voltage. The driving transistor TR1 is turned on by the voltage Vn1 of the first node N1 to transfer the voltage Vdj of the data line Dj to the second node N2. Accordingly, the voltage Vn2 of the second node N2 is a high level voltage.

As such, during the initialization period "a", the gate voltage of the driving transistor TR1 is initialized as the initialization voltage Vinit. During the initialization period "a", the initialization signal Gi of the gate-on voltage may be concurrently (e.g., simultaneously) applied to the pixels. In other words, the initialization signal applier 500 serves to concurrently (e.g., simultaneously) apply the initialization signal Gi of the gate-on voltage to the pixels. The voltages of the gate electrodes included in the pixels may be concurrently (e.g., simultaneously) initialized as the initialization voltage Vinit.

During the writing period "b", scan signals S[1]-S[n] of a plurality of gate-on voltages are sequentially applied to a plurality of scan lines. In this case, the initialization signal Gi and the light emission signal Em are applied as a gate-off voltage. A data voltage Vdat is applied to the data lines in response to the scan signals S[1]-S[n] of the gate-on voltages. A data voltage Vdat[j] to be written to a pixel 20 that is coupled to an $i^{th}$ scan line is applied to the data line Dj during a time b[i] at which a scan signal S[i] of the gate-on voltage is applied to the corresponding pixel 20. The data voltage Vdat[j] may have a predetermined range that is lower than that of the first power source voltage ELVDD. The switching transistor TR2 is turned on by the scan signal S[i] of the gate-on voltage to perform diode-connection of the driving transistor TR1. A driving voltage Vdat[j]−Vth obtained by subtracting a threshold voltage Vth of the driving transistor TR1 from the data voltage Vdat[j] is supplied to the gate electrode of the driving transistor TR1. The voltages Vn1 and Vn2 of the first node N1 and the second node N2 become the driving voltage Vdat[j]−Vth, and the driving voltage Vdat[j]−Vth is maintained by the storage capacitor Cst.

As such, during the writing period "b", the driving voltage Vdat[j]−Vth reflected with the data voltage Vdat[j] and the threshold voltage Vth of the driving transistor TR1 is written to each of the pixels.

During the light emission period "c", the light emission signal Em is applied as a gate-on voltage, and the initialization signal Gi and the scan signal S[i] are applied as a gate-off voltage. In this case, the first power source voltage ELVDD is applied to the data line Dj. The light emitting transistor TR3 is turned on by the light emission signal Em of the gate-on voltage to allow the driving current of the driving transistor TR1 to flow in the organic light emitting diode OLED. The organic light emitting diode OLED emits light with brightness corresponding to the driving current.

The driving current of the driving transistor TR1 is proportional to the square of a first voltage that is obtained by subtracting the threshold voltage Vth from a second voltage that is obtained by subtracting a gate voltage from a source voltage. In other words, the driving current of the driving transistor TR1 corresponds to the square of a voltage $[ELVDD-(Vdat-Vth)-Vth]^2=(ELVDD-Vdat)^2$ that is obtained by subtracting the threshold voltage Vth from a voltage ELVDD−(Vdat−Vth) that is obtained by subtracting the driving voltage Vdat−Vth from the first power source voltage ELVDD.

As such, the driving current flowing in the organic light emitting diode OLED corresponds to the data voltage Vdat regardless of a deviation of the threshold voltage Vth of the driving transistor TR1. As a result, no brightness deviation of the organic light emitting diode OLED is generated according to the deviation of the threshold voltage Vth of the driving transistor TR1.

During the light emission period "c", the light emission signal Em of the gate-on voltage may be concurrently (e.g., simultaneously) applied to the pixels to enable the pixels to concurrently (e.g., simultaneously) emit light. In other words, during the light emission period "c", the light emission signal applier 600 may concurrently (e.g., simultaneously) apply the light emission signal Em of the gate-on voltage to the pixels to enable the pixels to concurrently (e.g., simultaneously) emit light.

Figure 5:
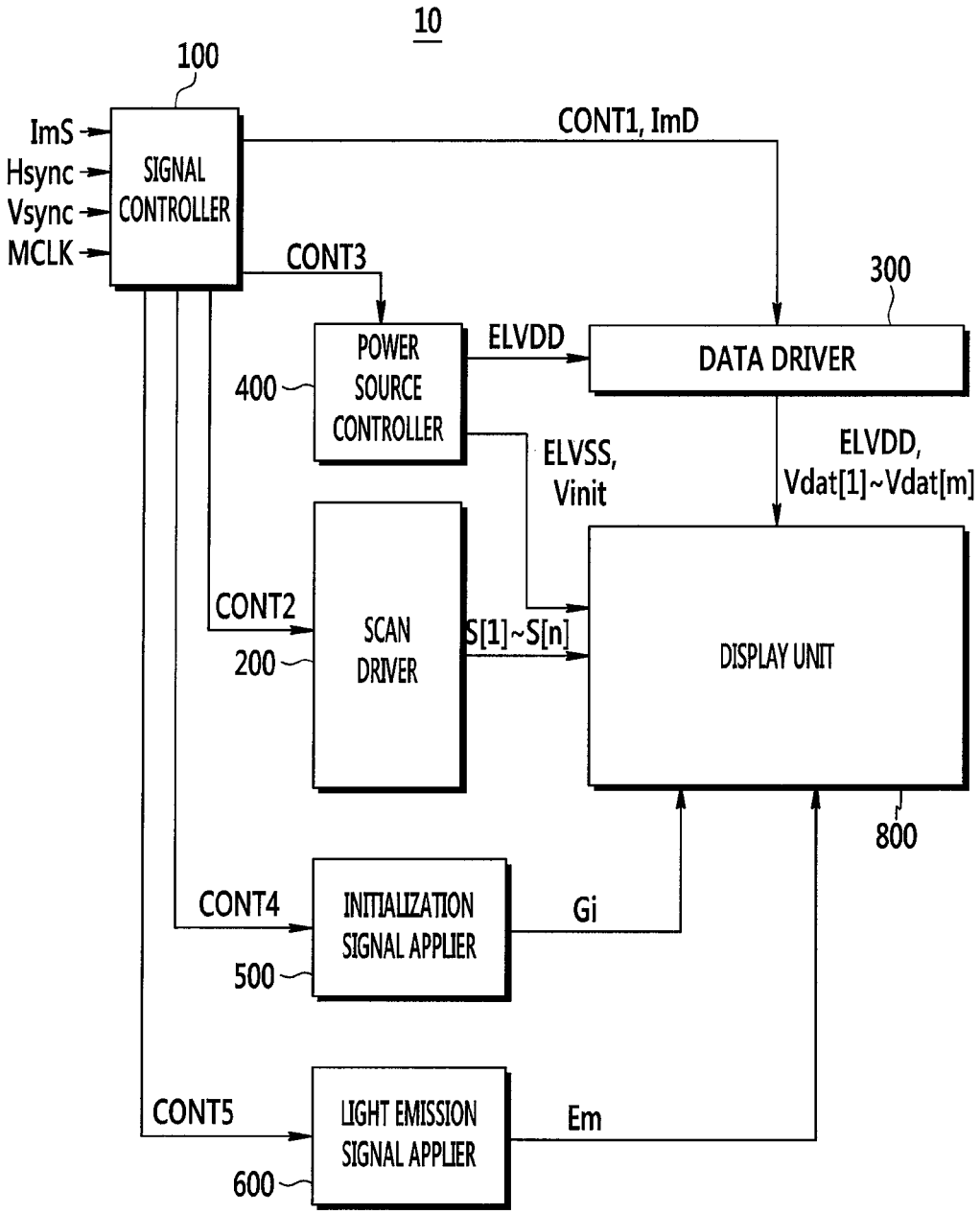
FIG. 5 is a block diagram illustrating a display device according to an example embodiment of the present invention.

FIG. 5 is a block diagram illustrating a display device according to an example embodiment of the present invention.

Referring to FIG. 5, the display device 10 includes a signal controller 100, a scan driver 200, a data driver 300, a power source controller 400, an initialization signal applier 500, a light emission signal applier 600, and a display unit 800. This configuration can be accomplished by including the function of the mux 700 in the data driver 300 in the display device of FIG. 1, or by excluding the mux 700 from the display device of FIG. 1.

As the function of the mux 700 is included in the data driver 300, the power source controller 400 transfers a first power source voltage ELVDD to the data driver 300. The data driver 300 may selectively apply the first power source voltage ELVDD and a plurality of data voltages Vdat[1]-Vdat[m] to a plurality of data lines according to a first driving control signal CONT1. For example, the data driver 300 may apply the first power source voltage ELVDD to the data lines during the initialization period "a" and the light emission period "c", and may apply the data voltage Vdat [1]-Vdat[m] to the data lines during the writing period "b".

Alternatively, the data driver 300 may generate the first power source voltage ELVDD and the data voltages Vdat [1]-Vdat[m]. In this case, the data driver 300 may generate the first power source voltage ELVDD autonomously instead of receiving it from the data driver 300.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims, and their equivalents. Therefore, those skilled in the art will understand that various modifications and other equivalent embodiments of the present invention are possible. Consequently, the true technical protective scope of the present invention must be determined based on the technical spirit of the appended claims, and their equivalents.

DESCRIPTION OF SYMBOLS

10: display device
20: pixel
100: signal controller
200: scan driver

300: data driver
400: power source controller
500: initialization signal applier
600: light emission signal applier
700: mux
800: display unit

What is claimed is:

1. A display device comprising:

a display unit comprising a plurality of scan lines that extend in a row direction, a plurality of data lines that extend in a column direction, and a plurality of pixels coupled to the scan lines and the data lines;

a scan driver configured to sequentially apply a scan signal of a gate-on voltage to the scan lines during a writing period for applying a data voltage to the pixels; and a data driver configured to apply a data voltage to the data lines during the writing period, wherein a first power source voltage supplying a driving current of the pixels is applied to the data lines during a period other than the writing period, wherein each of the pixels comprises:

an organic light emitting diode;

a driving transistor comprising a gate electrode coupled to a first node, a first electrode coupled to one of the data lines, and a second electrode coupled to a second node;

a switching transistor comprising a gate electrode to which the scan signal is applied, a first electrode coupled to the first node, and a second electrode coupled to the second node;

a light emitting transistor comprising a gate electrode to which a light emission signal is applied, a first electrode coupled to the second node, and a second electrode coupled to the organic light emitting diode;

an initialization transistor comprising a gate electrode to which an initialization signal is applied, a first electrode coupled to the first node, and a second electrode to which an initialization voltage is applied; and a storage capacitor comprising a first electrode coupled to the first node and a second electrode to which the initialization voltage is applied.

2. The display device of claim 1, further comprising a mux coupled to the data lines, to selectively transfer the data voltage and the first power source voltage to the data lines.

3. The display device of claim 1, further comprising an initialization signal applier configured to apply the initialization signal for initializing a gate voltage of a driving transistor included in each of the pixels.

4. The display device of claim 3, further comprising a light emission signal applier configured to apply the light emission signal for controlling a light emission period of the pixels.

5. The display device of claim 3, wherein the initialization signal applier concurrently applies an initialization signal of a gate-on voltage during an initialization period before the writing period.

6. The display device of claim 4, wherein the light emission signal applier concurrently applies a light emission signal of a gate-on voltage to the pixels during a light emission period after the writing period.

7. A display device comprising:

a plurality of scan lines that extend in a row direction;

a plurality of data lines that extend in a column direction; and a plurality of pixels coupled to the scan lines and the data lines, wherein a scan signal of a gate-on voltage is sequentially applied to the pixels during a writing period for applying a data voltage to the pixels, a data voltage is applied to the data lines during the writing period, and a first power source voltage supplying a driving current of the pixels is applied to the data lines during a period other than the writing period, wherein each of the pixels comprises:

an organic light emitting diode;

a driving transistor comprising a gate electrode coupled to a first node, a first electrode coupled to one of the data lines, and a second electrode coupled to a second node;

a switching transistor comprising a gate electrode to which the scan signal is applied, a first electrode coupled to the first node, and a second electrode coupled to the second node;

a light emitting transistor comprising a gate electrode to which a light emission signal is applied, a first electrode coupled to the second node, and a second electrode coupled to the organic light emitting diode, an initialization transistor comprising a gate electrode to which an initialization signal is applied, a first electrode coupled to the first node, and a second electrode to which an initialization voltage is applied; and a storage capacitor comprising a first electrode coupled to the first node and a second electrode to which the initialization voltage is applied.

8. The display device of claim 7, wherein the initialization signal is concurrently applied to the pixels as a gate-on voltage during an initialization period of the writing period.

9. The display device of claim 7, wherein the light emission signal is concurrently applied to the pixels as a gate-on voltage during a light emission period after the writing period.

10. A driving method of a display device, the display device comprising an organic light emitting diode, a driving transistor configured to control a driving current that is supplied from a data line to the organic light emitting diode, a switching transistor configured to perform a diode connection of the driving transistor, a light emitting transistor configured to transfer the driving current from the driving transistor to the organic light emitting diode, an initialization transistor configured to transfer an initialization voltage to a gate electrode of the driving transistor, and a storage capacitor configured to store a gate voltage of the driving transistor, the driving method comprising:

initializing the gate voltage of the driving transistor as an initialization voltage by applying an initialization signal of a gate-on voltage to a gate electrode of the initialization transistor during an initialization period;

storing a driving voltage on which a data voltage and a threshold voltage of the driving transistor are reflected in the storage capacitor by applying a scan signal of a gate-on voltage to a gate electrode of the switching transistor and the data voltage to the data line during a writing period; and enabling the organic light emitting diode to emit light by applying a light emission signal of a gate-on voltage to a gate electrode of the light emitting transistor during a light emission period.

11. The driving method of claim 10, wherein the initialization signal of the gate-on voltage is concurrently applied to a plurality of pixels of the display device.

12. The driving method of claim 10, wherein the scan signal of the gate-on voltage is sequentially applied to a plurality of scan lines that are coupled to a plurality of pixels of the display device during the writing period.

13. The driving method of claim 10, wherein a first power source voltage for supplying a driving current of a plurality of pixels of the display device is applied to the data line during the light emission period.

14. The driving method of claim 13, wherein the light emission signal of the gate-on voltage is concurrently applied to a plurality of pixels of the display device.

15. The driving method of claim 13, wherein the first power source voltage is applied to the data line during the initialization period.

* * * * *